US005338040A

United States Patent [19]

Cutler

[11] Patent Number: 5,338,040

[45] Date of Patent: Aug. 16, 1994

[54] THREE-DIMENSIONAL CHESS

[76] Inventor: Gerald Cutler, 3558 Agate Dr., #5, Santa Clara, Calif. 95051

[21] Appl. No.: 136,683

[22] Filed: Oct. 14, 1993

[51] Int. Cl.[5] ..... A63F 3/02

[52] U.S. Cl. ..... 273/241; 273/261

[58] Field of Search ..... 273/241, 260, 261

[56] References Cited

U.S. PATENT DOCUMENTS

| | | | |
|---|---|---|---|
| 3,684,285 | 8/1972 | Kane | 273/241 |
| 3,767,201 | 10/1973 | Harper et al. | 273/241 |
| 3,937,471 | 2/1976 | Brennan | 273/241 |
| 4,133,537 | 1/1979 | Chappell | 273/241 |
| 4,927,157 | 5/1990 | Riihiluoma et al. | 273/241 X |
| 5,031,917 | 7/1991 | Greene | 273/261 |
| 5,112,056 | 5/1992 | Ching | 273/241 |
| 5,193,813 | 3/1993 | Goff | 273/241 |

FOREIGN PATENT DOCUMENTS

| | | | |
|---|---|---|---|
| 2838140 | 3/1980 | Fed. Rep. of Germany | 273/241 |
| 2907872 | 9/1980 | Fed. Rep. of Germany | 273/241 |
| 2237213 | 5/1991 | United Kingdom | 273/241 |

*Primary Examiner*—William E. Stoll
*Attorney, Agent, or Firm*—James J. Leary

[57] ABSTRACT

A three-dimensional chess game which is played on a four by four by four cubic chessboard. The boards are arranged so that the light and dark squares alternate in the vertical direction, which makes the three-dimensional play more analogous to two-dimensional chess. The game is played with two standard sixteen piece per side chess sets. The game starts with the pieces arranged on diametrically opposite edges of the cubic game board, with the white playing pieces arranged in the first two rows of the bottom two levels and the black playing pieces arranged in the last two rows of the top two levels. The playing pieces are assigned unique movements which are three-dimensional extensions analogous to their movements in two-dimensional chess. The rook is assigned a special movement having three modes, a horizontal mode, a frontal mode, and a side mode. The rook may move in one direction in any of three orthogonal directions when it is in any of the three modes. The rook is also allowed to move sequentially in two orthogonal directions in a specified order, within the horizontal, frontal or side plane corresponding to the mode it is in. The rook is defined as being in the horizontal mode at the beginning of a game, and when the rook moves in one direction only, the rook changes mode to the mode corresponding to the horizontal, frontal or side plane perpendicular to the direction in which it moves.

18 Claims, 8 Drawing Sheets

ROOK MOVEMENT-
HORIZONTAL MODE

LOCATION NOTATION

INITIAL POSITION

KING MOVEMENT

KNIGHT MOVEMENT

PAWN MOVEMENT
→ CAPTURE

PAWN SPECIAL MOVEMENT

BISHOP MOVEMENT

BISHOP MOVEMENT-BLOCKAGE

ROOK MOVEMENT-HORIZONTAL MODE

ROOK MOVEMENT-BLOCKAGE

ROOK MOVEMENT-
FRONTAL MODE

ROOK MOVEMENT-
SIDE MODE

QUEEN MOVEMENT
FRONTAL MODE

THREE-DIMENSIONAL CHESS

FIELD OF INVENTION

The present invention relates to a board game. More particularly, it relates to a game with chess-like playing pieces which is played on a three-dimensional game board.

BACKGROUND OF THE INVENTION

Chess is a game of strategy, often classified as a game of war. The origins of chess have been traced back thousands of years to board games played in ancient Egypt and other parts of the Orient. The game assumed its present physical form in about the eight century A.D. in India, from where, the game diffused to Europe. The current rules for the game of chess are said to have come out of Spain in the latter part of the fifteenth century. Until that time, each country and each region had its own local variation of the game rules. The standardized rules that we know today have completely replaced the local variations of centuries ago.

Since the standardization of chess, many variations of the game have been proposed having different rules or different playing pieces and game boards. One such variation of the game is three-dimensional chess or Schachraumspiel, first described by Dr. Ferdinand Maack in 1908. Since the first introduction of three-dimensional chess, many variations of the game have been developed. Typically these games have had three or four, or even eight, eight by eight chess boards stacked one above the other to create a three-dimensional game board. Different rules and variations of the playing pieces have also been proposed. None of these games have caught up to, or even come close to, the popularity of standard two-dimensional chess. Part of the reason for this is that all of the proposed games have had one or more drawbacks that detract from the fun or excitement of the game. Some of these problems are summed up very well by Mr. R. Wayne Schmittberger on pages 103–104 of his book *New Rules for Classic Games* (Wiley & Sons, Inc., 1992):

> "Did you ever buy one of the many different three-dimensional chess games on the market that use three 8×8 boards? If you played it, did you find some serious problems, such as being unable to mate a king even when you were three queens ahead?
>
> Commercial three-dimensional chess sets come with many different rules, most of which have one thing in common: they're very bad. They attempt to extend two-dimensional movement into three dimensions without taking into account the differences between plane and solid geometry or the problems humans have visualizing some kinds of three-dimensional moves."

Mr. Schmittberger goes on to propose two variations of three-dimensional chess games for playing on three, eight by eight chess boards arranged to make a three-dimensional game board. While these proposed variations go a long way toward alleviating the problems identified by Mr. Schmittberger, at least in the eyes of this inventor, they do not go far enough.

One of these problems is that with a three by eight by eight board there is just too much territory to cover with the standard sixteen chess pieces. This problem is just compounded by even larger game boards, such as the eight by eight by eight board described by Maack. Some variations have proposed adding more pieces to the game, but this complicates the game and brings it farther away from being a three-dimensional extension of standard chess. Another problem of prior art games is that checkmate is very difficult to achieve because the additional freedom of movement of the pieces has not been compensated by additional capturing power. Both of these problems contribute to the fact that most of the prior art three-dimensional chess games take much longer to play to resolution than a standard chess game. Consequently, the game frequently ends in boredom, rather than checkmate. This is very counterproductive since the original reason for adding a third dimension to the game was to make it more fun and exciting.

Another problem of prior art chess games, including three-dimensional chess, is the first-move advantage that the white pieces have. Statistically, the white pieces in two-dimensional chess have a significant first-move advantage. In tournament play, about sixty percent of chess games played to checkmate are won by the white pieces. In some three-dimensional chess games this advantage may be even more imbalanced. It makes the entire game hardly worth playing when the eventual outcome of the game is decided by drawing lots to see who makes the first move.

Many of the prior art three-dimensional chess games do not successfully extend the chess game into three dimensions. They are still very much planar games that have three separate levels that pieces can move between. Some of this is caused by the three by eight by eight arrangement that allows much more movement in the horizontal planes than in the vertical planes. Another reason is that most of the proposed rules restrict the vertical movement of the pieces so that the play in the vertical planes is not really analogous to standard chess play.

SUMMARY OF THE INVENTION

The primary objective of the present invention is to make the play of chess more fun and exciting by fully extending the play into three dimensions. One component of this objective is to make the movement of the playing pieces in three dimensions analogous to their movement in two dimensions in standard chess. This includes keeping the relative ranking or hierarchy between the various pieces, in terms of freedom of movement and capturing power, the same as in standard chess. Another component of this objective is to make movements of the pieces in the vertical planes very similar to their movements in the horizontal planes. This means that the playing board must be equally extensive in all three dimensions so that pieces can have the same degree of movement in vertical planes as in horizontal planes. This also means that the pieces must be able to capture while moving in the vertical planes the same way that they can in the horizontal planes. These aspects are what makes the game fully three-dimensional, rather than just a planar game on multiple levels.

To make the game as analogous as possible to standard chess, it is also an objective to make the length of a typical game the same as for standard chess. This means that it should take the same number of moves to reach checkmate or another resolution to the game as in standard chess. It should be no harder and no easier to reach checkmate. Also, it should be possible to force checkmate with the same combinations of pieces as in standard chess. An example of this is that it should be possible to create a checkmate with a bishop and a knight as the offensive pieces. It is not possible to reach checkmate with this combination in some prior art three-dimensional chess games. To make this possible, it is necessary to increase the capturing power of the pieces to compensate for the additional freedom of movement in three dimensions, while maintaining their relative ranking as mentioned above. Another aspect of making checkmate possible is to limit the mobility of the king somewhat so that it cannot slip through a well-mounted attack. Most three-dimensional chess games have gone too far in increasing the mobility of the king so that its ranking is out of keeping with its ranking in two-dimensional chess.

Another part of keeping the game moving at the same pace as in standard chess is making the playing area the same as a standard chessboard. With eight, eight by eight boards, the pieces are too spread out; the first part of the game is spent just setting up for offensive attack by bringing the pieces within striking range of one another. The present invention uses a four by four by four game board, which has exactly the same playing area as a standard eight by eight chessboard.

Another objective is to minimize the first-move advantage that the white pieces have in many other three-dimensional chess games. By carefully adjusting the mobility and relative strengths of the pieces, particularly by increasing the relative strength of the pawns, the unbalanced first-move advantage that is inherent in other three-dimensional chess games can be eliminated.

Another objective of the invention is to make a three-dimensional chess game which can be easily understood and visualized by the players. Several factors contribute to the ease of visualization of the present invention as compared to the prior art. The first factor, of course, is to limit the size of the game board to a manageable size for mentally visualizing the game. Another factor is to make the movements of the playing pieces analogous to their movements in two-dimensional chess. This greatly aids the retention and visualization of the game rules for those who are already familiar with standard chess. Another factor that aids retention of the game rules is to supply mnemonics that will help the players to remember the rules and to visualize the spatial movements of the playing pieces.

In keeping with these objectives the present invention takes the form of a chess game which is played on four, four by four chessboards, which are arrange vertically to create a cubic three-dimensional game board. The game board has exactly 64 squares, which is the same size as a standard two-dimensional chessboard. Unlike prior art three-dimensional chess games, the boards are arranged so that the light and dark squares alternate in the vertical direction. In some ways this makes the three-dimensional play more analogous to two-dimensional chess.

The game is played with a standard sixteen piece per side chess set. The game starts with the pieces arranged on diametrically opposite edges of the cubic game board. The white playing pieces are arranged in the first two rows of the bottom two levels and the black playing pieces are arranged in the last two rows of the top two levels. The playing pieces are assigned unique movements which are three-dimensional extensions analogous to their movements in two-dimensional chess. The movements of the pieces and other aspects of the game will now be described in detail with reference to the accompanying drawings in which:

DETAILED DESCRIPTION OF THE INVENTION—APPARATUS THE BOARD

Figure 1:
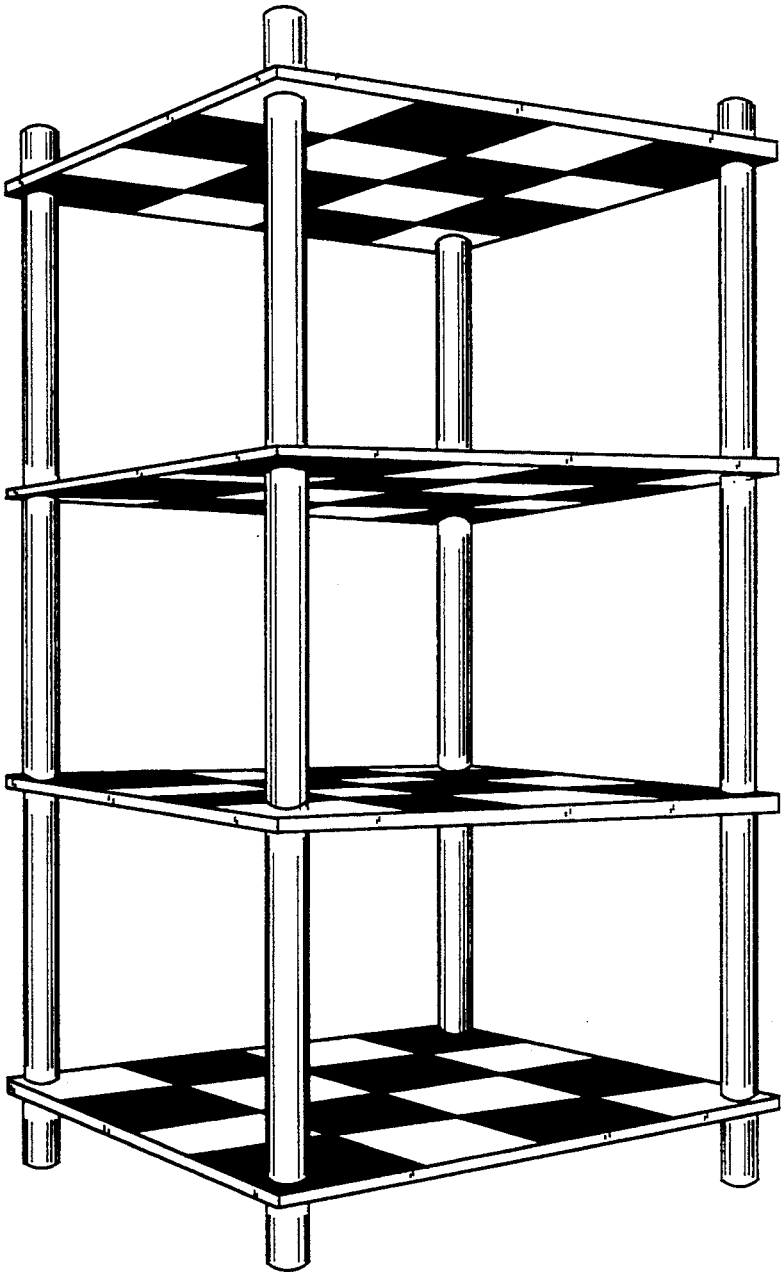
FIG. 1 shows a perspective view of the game board.

The game board is illustrated in FIG. 1. The game board is made up of four, four by four chessboards, which are arrange vertically to create a cubic three-dimensional game board. The game board has exactly 64 squares, so it has the same playing area as a standard two-dimensional chessboard. The squares on each of the boards are colored so that alternating squares contrast with one another. Preferably, half of the squares are made clear and the other squares are shaded with a transparent color so that the entire game board can be seen from almost any viewing angle. Alternatively, the squares can be colored with any two contrasting colors. The boards are arranged so that the clear and shaded squares alternate in the vertical direction. That way when pieces move vertically from one level to the next, they move from a clear square to a shaded square and back to a clear square, just the way they would moving front to back or left to right in a two-dimensional chess game. Also when a diagonally moving piece, such as a bishop, moves from one level to the next it remains on the same color squares just as in two-dimensional chess. This makes the three-dimensional play somewhat more analogous to two-dimensional chess than in prior art three-dimensional chess games.

LOCATION NOTATION

Figure 2:
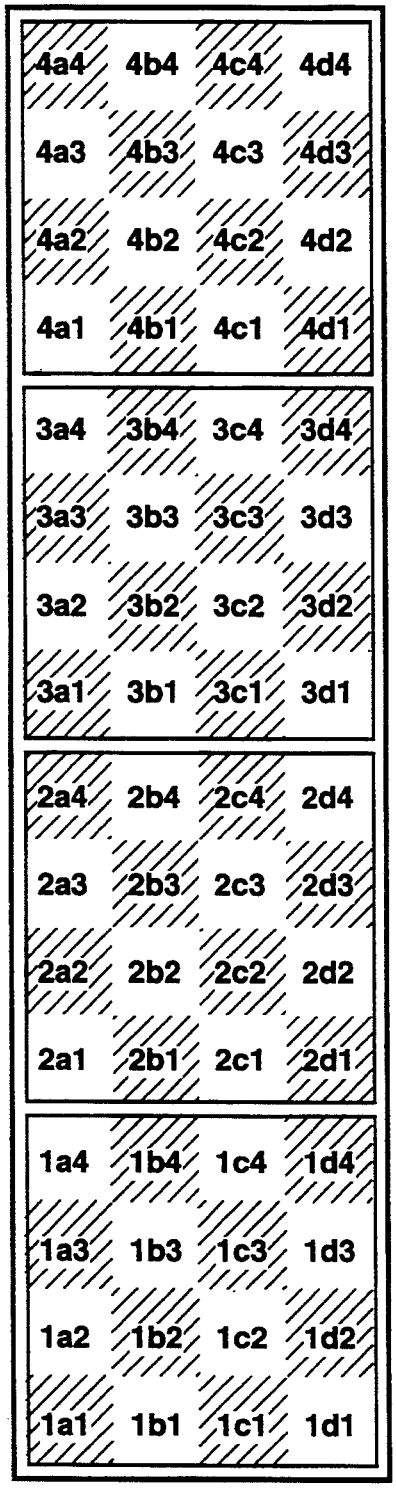
FIG. 2 shows the notation for locations used in the description.

For simplicity in illustrating and visualizing the movements of the playing pieces, the game board will be shown laid out flat as in FIG. 2 for the remainder of the detailed description. The bottom level of the game board in FIG. 1 is called level 1 and it is shown in the bottom of the diagram in FIG. 2. The top level of the game board in FIG. 1 is called level 4 and it is shown in the top of the diagram in FIG. 2. We will adopt a special notation for referring to the squares in the game, where the first digit is a number designating the level of the square, the second digit is a letter designating the column of the square, and the third digit is a number designating the row of the square. The levels are 1 through 4, starting from the bottom. The columns are a through d, starting from the left (in the illustrations, and from White's point of view). Similarly, the rows are 1 through 4, starting from the front. Thus the notation 4c3 designates the square at level 4, column c, row 3. The illustration in FIG. 2 shows the location notation for each square on the board.

Another important concept for understanding of the game is the concept of movement within a plane. There are three types of planes that will be talked about in the description: horizontal planes, frontal planes and side planes. A horizontal plane includes all of the squares on one level of the game board. A frontal plane is a vertical plane that faces the front of the game board. Thus, all squares with the same row number will be within the same frontal plane. A side plane is a vertical plane that faces the sides of the game board. Thus, all squares with the same column number will be within the same side plane.

THE PIECES

The game is played with a standard set of chess pieces with sixteen playing pieces per side. The playing pieces on the two sides are colored with any two contrasting colors. For simplicity, the two colors will be referred to as black and white in the description below. Table 1 shows the number of each piece per side in the game and the relative value of each piece. The relative values of the pieces are approximate and are based on the mobility of the playing pieces on the board and their capturing power. These rankings maintain the relative strengths of the pieces as in standard chess.

TABLE 1

| Name | Number each side | Relative value each |
|---|---|---|
| King | 1 | |
| Queen | 1 | 9 |
| Rook or Castle | 2 | 5 |
| Knight | 2 | 3 |
| Bishop | 2 | 3 |
| Pawn | 8 | 1 |

DETAILED DESCRIPTION OF THE INVENTION—METHOD OF PLAY THE RULES

Figure 3:
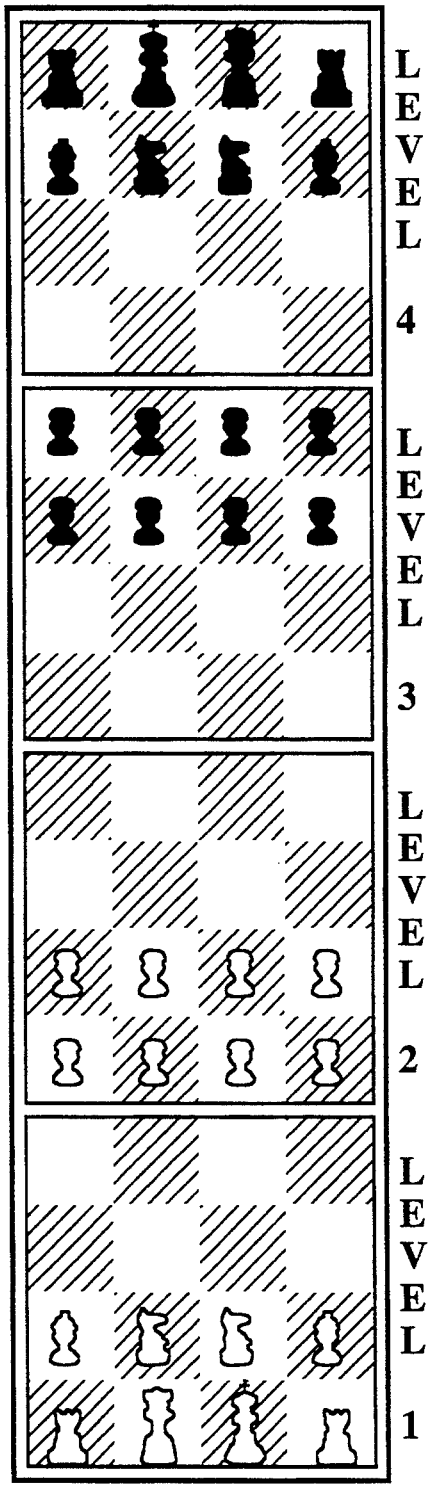
FIG. 3 shows the starting positions of the playing pieces.

The starting positions of the pieces are illustrated in FIG. 3. The white pieces start in the first two rows of the bottom two levels. The black pieces start in the last two rows of the top two levels. Deciding which player will have the white pieces and which will have the black pieces is usually done by drawing lots. If multiple games are played the players can alternate between the black and the white pieces, or the sides can be chosen after each game by winner's choice (or loser's choice to even out the advantage, if preferred.) The movement sequence is simple. First White, the player with the white pieces, moves one of his pieces. Then Black moves one of his pieces. Players continue to alternate moves until one wins by capturing his opponent's king. You may never move an opponent's piece. You may never move onto a square already occupied by one of your pieces.

You capture an opponent's piece by moving onto the square it used to occupy. You attack a piece by moving so that you can capture it in your next move. If your opponent moves so you can capture his piece, you may do so. Once you have captured it, you remove it from the board, and it plays no further role in the game.

The goal of the game is to capture your opponent's king. If you attack (that is, threaten to capture) his king, you say "check." His king is under check if it is being attacked. He must get out of check by moving his king or capturing your attacking piece. If he cannot get out of check in one move, then he is checkmated, and you have won.

A player may never move his king into check. If it is impossible for him to avoid doing so and his king is not in check, this is called stalemate, and the game is a draw (a tie). The game may end prior to a stalemate or checkmate if the players agree to a draw, or a player resigns (admits defeat).

KING MOVEMENT

The king may move to any adjacent square or any diagonally adjacent square on the horizontal or frontal planes. The horizontal plane is a level. The frontal plane is the vertical plane that faces the front. The king cannot be blocked from moving to a square by a piece in another square.

Figure 4:
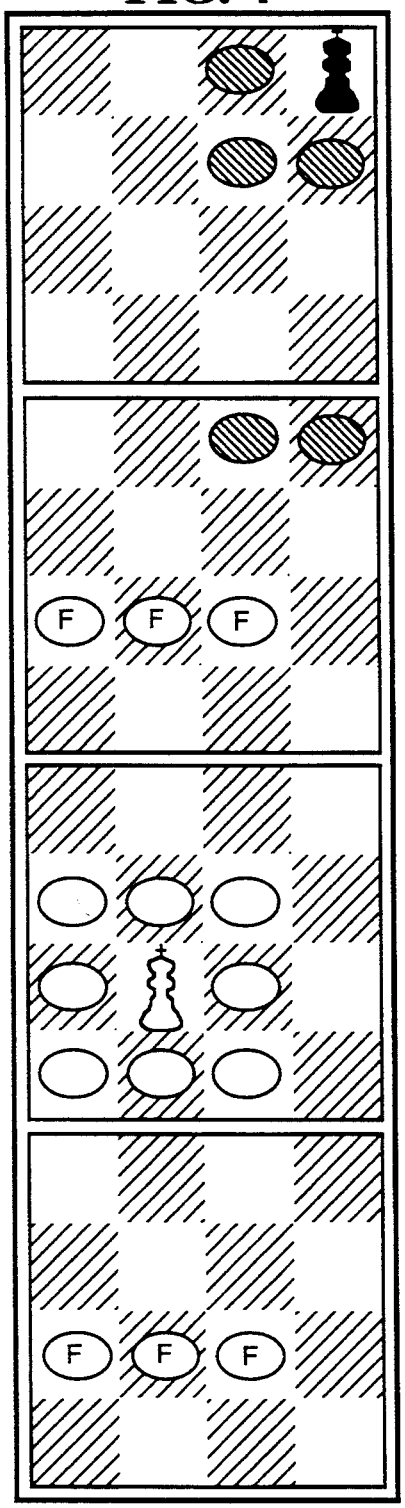
FIG. 4 shows the movements of the king.

Two examples are shown in FIG. 4. The black king may move to any square with a black circle in it. The white king may move to any square with a white circle in it. White circles labeled with F are adjacent frontal plane squares for White.

KNIGHT MOVEMENT

Figure 5:
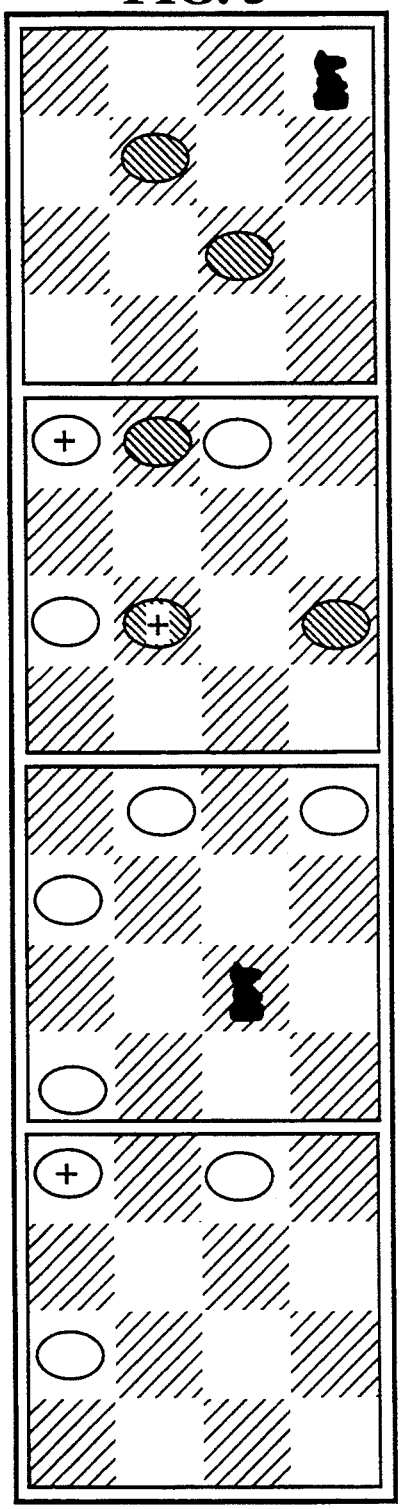
FIG. 5 shows the movements of the knight.

The knight may move one square in any non diagonal direction, and then two squares in a non vertical direction that is perpendicular to the first move. Optionally, it may also make a third move of two squares in a non vertical direction perpendicular to the first two moves. The knight may jump over pieces; it is never blocked. A knight starting on a clear square lands on a shaded square, and vice versa. Two examples of knight movements are diagrammed for the black knight and the white knight in FIG. 5. The squares marked with a + show the squares that each of the knights can move to if the optional movement in a third direction is used.

PAWN MOVEMENT

On the same level, the pawn moves straight forward one square. Between levels, the pawn moves one square backward (towards row 1 for White, towards row 4 for Black) and one level towards the opponent (up for White, down for Black).

The pawn captures differently than it moves. If an opposing piece is to either side of where the pawn normally moves, the pawn may capture that piece by moving into the square it occupies. Thus on the same level, the pawn captures diagonally forward one square, and between levels, the pawn captures diagonally backward and up (for white) or down (for black).

Figure 6:
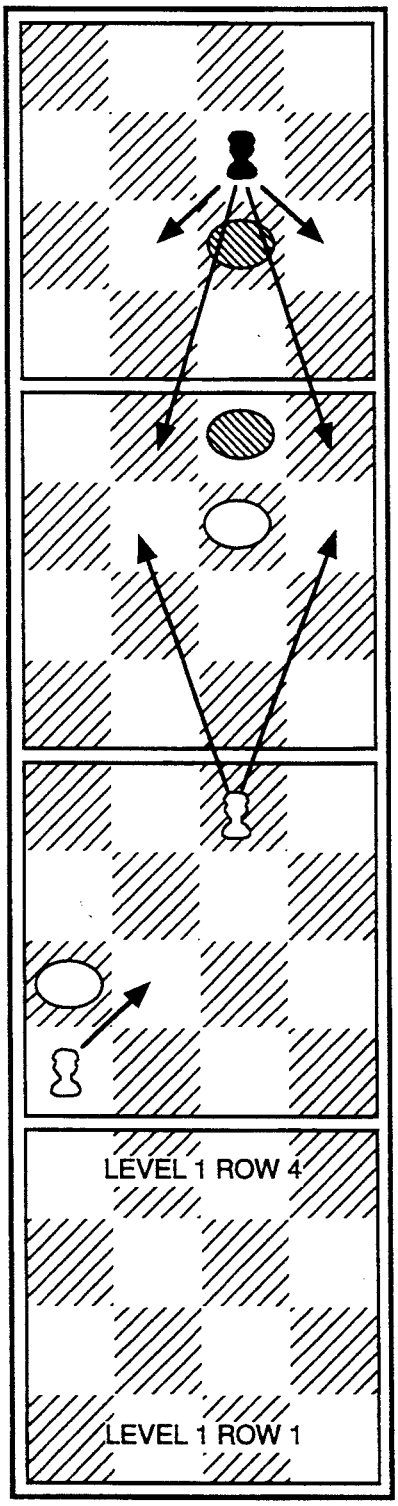
FIG. 6 shows the movements and capture by the pawn.

The pawn is blocked from moving to a square if and only if a piece is already on that square. The pawn cannot be blocked from moving to a square by a piece on a different square. If an opposing piece is one square straight forward, the pawn cannot move forward. If an opposing piece is one square diagonally forward, the pawn may capture it by moving into that square. Three examples of pawn movement and capture are diagrammed in FIG. 6.

PAWN SPECIAL RULES

Figure 7:
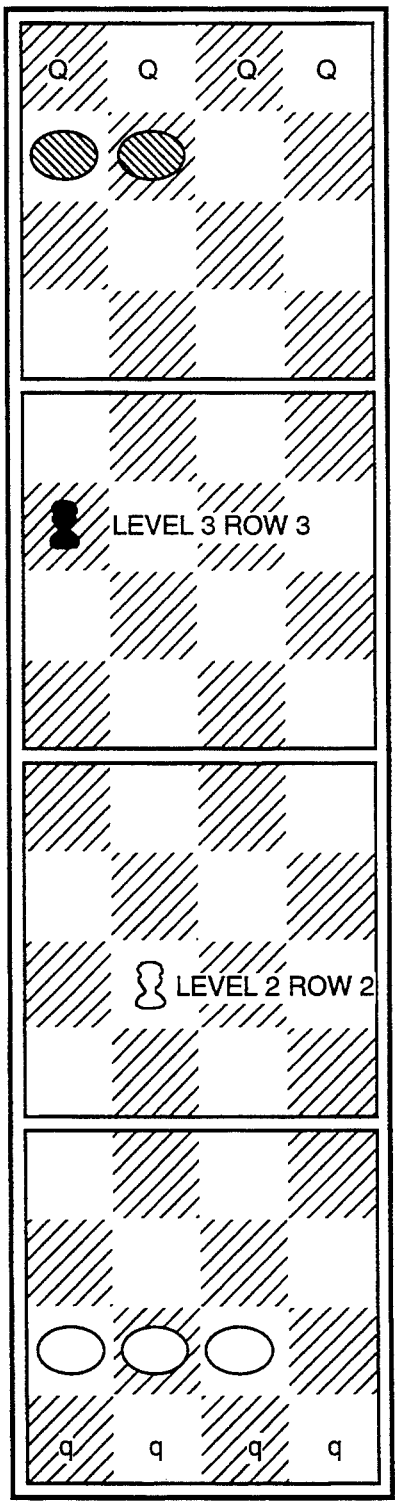
FIG. 7 shows special movements of the pawn.

A pawn may castle by retreating one level (up for Black, down for White), and optionally moving sideways one square. Two examples are shown in FIG. 7. A castling pawn cannot be blocked. In order to castle, the following conditions must be met:

1) The pawn must be White and on level 2 row 2, or Black and on level 3 row 3.
2) The square the pawn is moving to must be unoccupied.

Another special rule is that when your pawn has moved as far as possible, you may promote it to a piece of your choice other than a king (usually a queen). As far as possible for white means moving to level 4 row 4, for black it means moving to level 1 row 1. In the illustration in FIG. 7, these squares are labeled Q for White and q for Black.

BISHOP MOVEMENT

Figure 8:
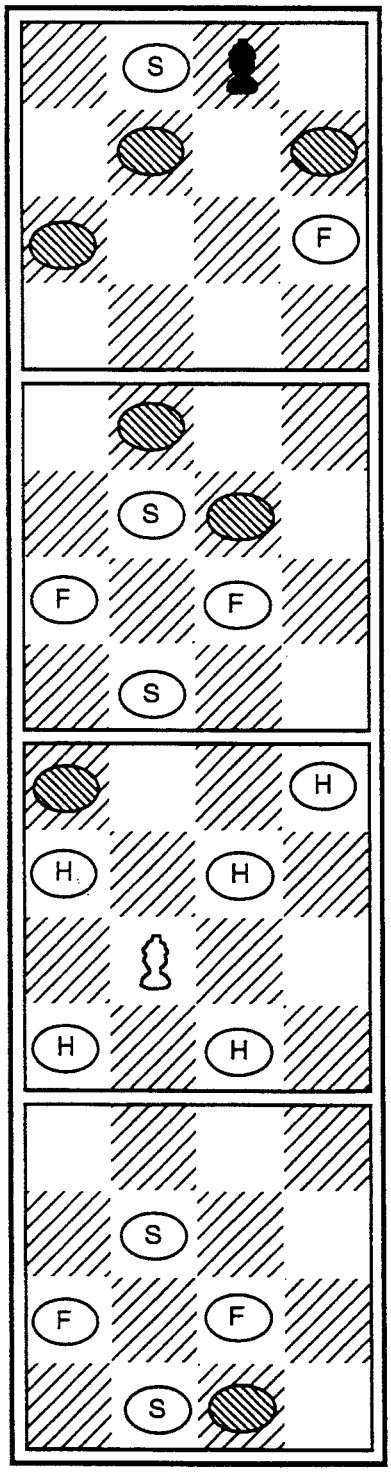
FIG. 8 shows the movements of the bishop.

The bishop may move diagonally in any plane. The diagram in FIG. 8 shows two examples. The white circles labeled H indicate legal (diagonal) moves in the horizontal plane (a level) for the white bishop. Similarly, the circles labeled S are legal moves for the side plane (the vertical plane facing the side), and the circles labeled F are legal moves for the frontal plane (the vertical plane facing the front).

Figure 9:
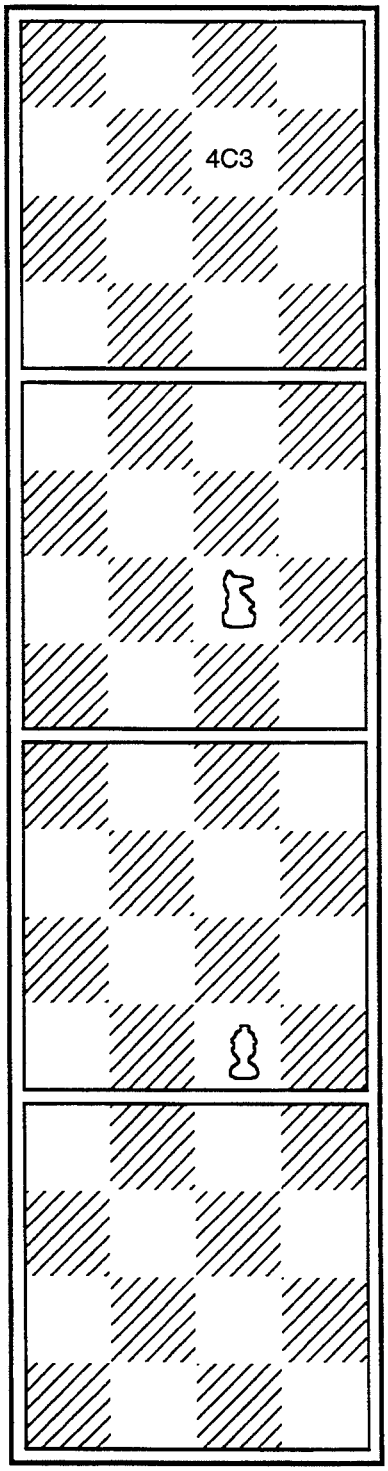
FIG. 9 illustrates blockage of the bishop.

Unlike the king, knight, and pawn, the bishop can be blocked from the square you want it to go to by a piece in another square. In the example in FIG. 9, the bishop cannot move to the square labeled 4c3, because it is blocked by (and cannot jump over) the knight.

ROOK MOVEMENT

Introduction

Rook movement is complex. A rook can move in any straight (non diagonal) direction. The rook has three different modes of movement: horizontal mode, frontal mode and side mode. If it moves in one direction only, it switches modes. The rook can also move anywhere within a plane (subject to restrictions). Which plane the rook can move within depends upon which mode it is in.

A convention: bars

A horizontal bar drawn above the rook designates it as being in frontal mode; a vertical bar means it is in side mode; no bar indicates that it is in horizontal mode. The following examples use this convention in the illustrations to indicate the mode of the rooks. While playing you should place a plastic marker in a rook's square laid from side to side for a frontal mode rook, and laid from front to back for a side mode rook. A horizontal mode rook should have no marker.

Movement in 1 direction

Irrespective of mode, the rook can move in any straight (non diagonal) direction: left, right, forwards, backwards, up, or down. It can be blocked.

Movement in 2 directions

As mentioned above, the rook has three modes of movement corresponding to the three types of planes: horizontal mode, frontal mode and side mode. These modes become important when the rook is moved in two directions in the same move. Subject to certain restrictions, in horizontal mode the rook may move anywhere in the horizontal plane (that it is in). Similarly, in frontal mode it may move anywhere in the frontal plane, and in side mode it may move anywhere in the side plane.

For movement in 2 directions in one move, there are the following restrictions:

1) Each direction must be straight and non diagonal (i.e. left, right, forwards, backwards, up, or down).
2) The two directions must be perpendicular.
3) The rook cannot jump over a piece (i.e. the rook can be blocked).
4) The rook must remain within the plane corresponding to the mode that it is in.
5) THE DIRECTIONS MUST BE MOVED IN A PARTICULAR ORDER.

Order of movement for moving in 2 directions:

When a rook moves 2 directions in one move, IT MUST MAKE THE MOVEMENTS IN THE FOLLOWING ORDER:

1) Left or right.
2) Forwards or backwards.
3) Up or down.

A mnemonic for remembering the order is:

"Before crossing the street, look left and right before moving forward, or you may make a final vertical movement."

Horizontal Mode

Figure 10:
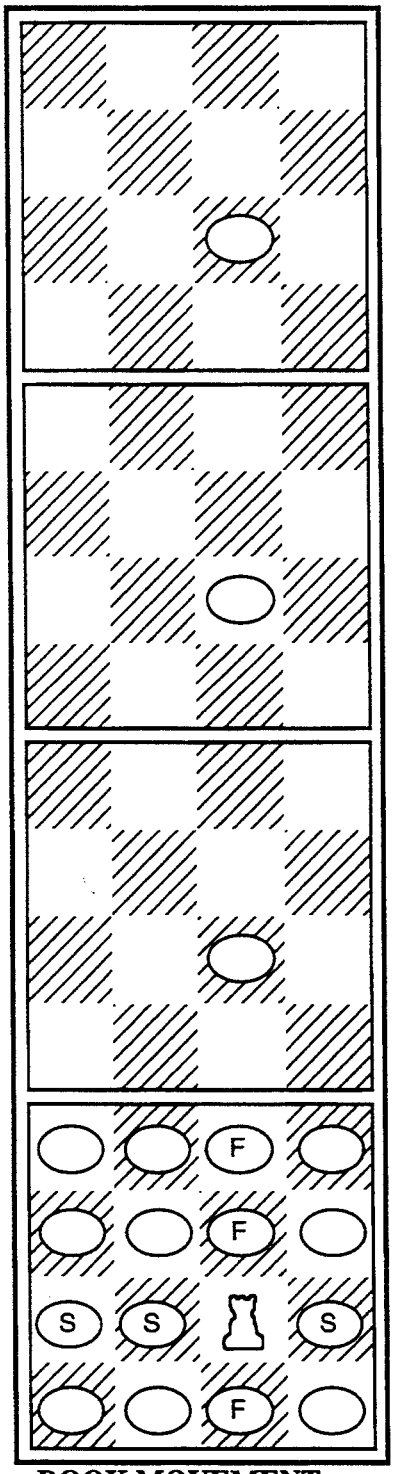
FIG. 10 shows the movements of the rook in the horizontal mode.
Figure 11:
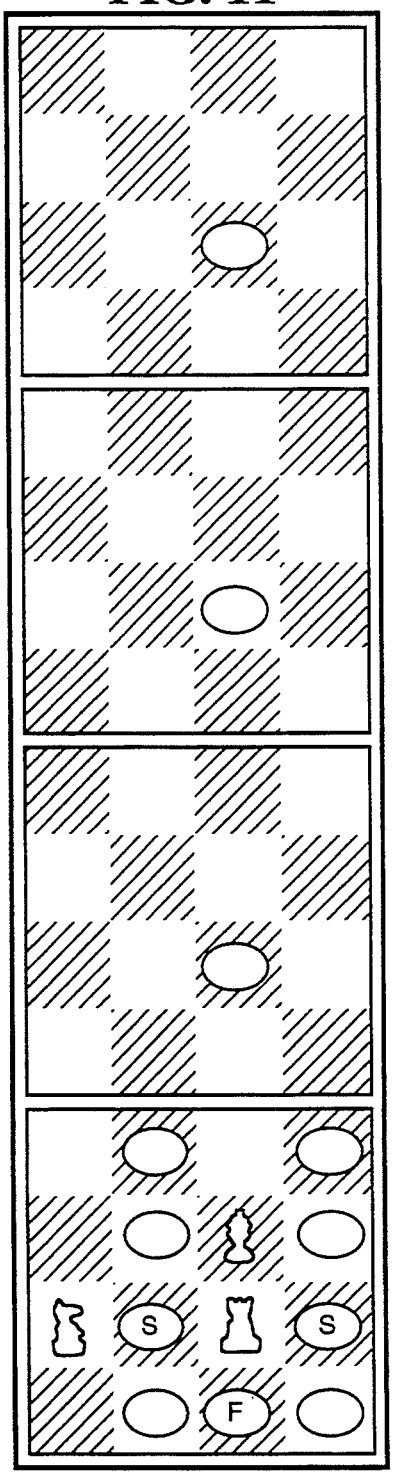
FIG. 11 illustrates blockage of the rook.

An example of movement for horizontal mode rooks is shown in FIG. 10. The rook switches to frontal mode if it moves to any of the squares labeled F, and it switches to side mode if it moves to any of the squares labeled S. The example in FIG. 11 shows the squares that a horizontal mode rook can move to when it is blocked by two pieces.

Mode switching

WHEN A ROOK MOVES IN JUST ONE DIRECTION, IT SWITCHES TO THE MODE CORRESPONDING TO THE PLANE IT MOVES PERPENDICULAR TO. For example, a rook that moves only sideways switches to side mode, and a rook that moves only forward switches to frontal mode. (A rook may switch to a mode that it is already in). When a rook moves in 2 directions, it does not switch modes. When it moves in 1 direction, it must switch modes. The rook is initially in horizontal mode.

Figure 12:
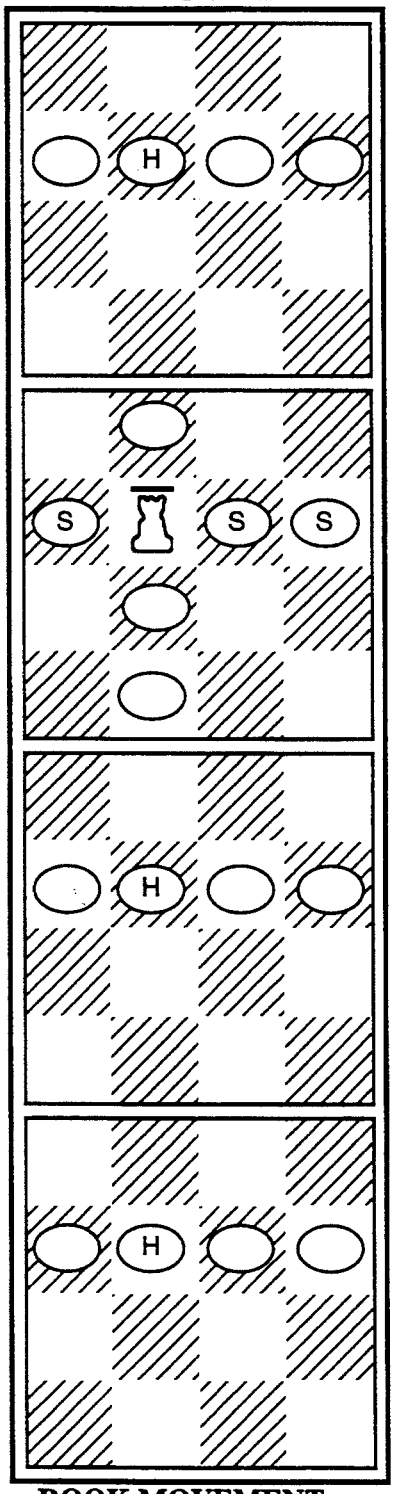
FIG. 12 shows the movements of the rook in the frontal mode.
Figure 13:
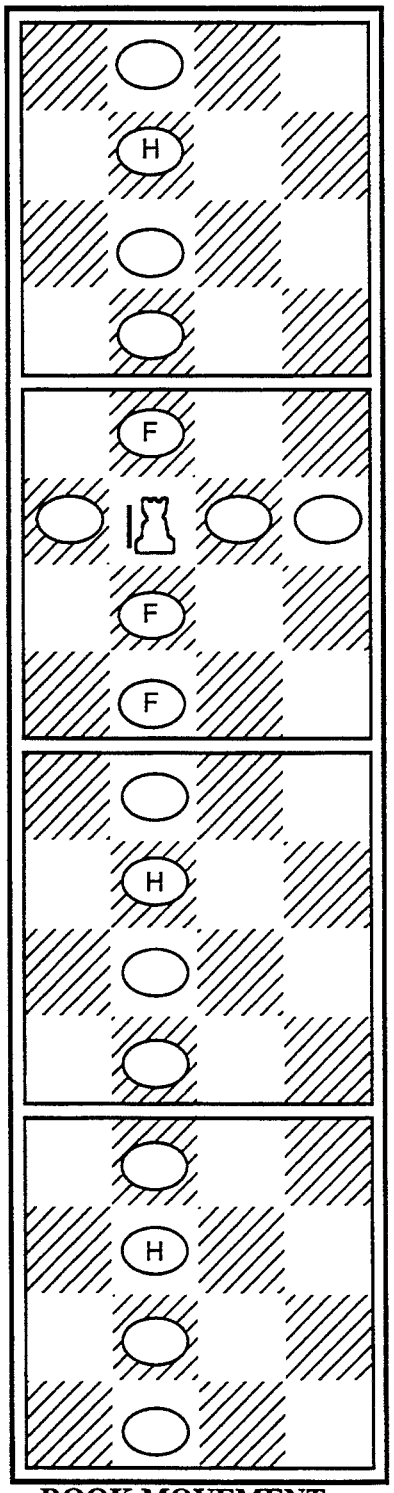
FIG. 13 shows the movements of the rook in the side mode.

The figures illustrate several examples of mode switching. In FIG. 10 is shown an example of movement for a horizontal mode rook. It switches to frontal mode if it moves to a square labeled F, and it switches to side mode if it moves to a square labeled S. In FIG. 11 is an example of movement for a horizontal mode rook that is blocked by two pieces. An example of frontal mode movement is shown in FIG. 12 and an example of side mode movement is shown in FIG. 13. In each of these figures, the H, F, and S square labels designate what mode the example rooks switch to if they move to that square: horizontal, frontal, or side.

TABLE 2

Rook Movement Summary Table

| | | 1 direction, mode switches to: | | |
|---|---|---|---|---|
| | 2 directions | Horizontal | Frontal | Side |
| Horizontal mode | left or right THEN forwards or backwards | up or down | forwards or backwards | left or right |
| Frontal mode | left or right THEN up or down | up or down | forwards or backwards | left or right |
| Side mode | forwards or backwards THEN up or down | up or down | forwards or backwards | left or right |

Rook Movement Summary

The rook always moves in the following straight non diagonal directions: left, right, forwards, backwards, up, or down. In one move it may move in either one or two directions.

If the rook moves in just one direction, it switches modes to the plane perpendicular to that direction, as shown in the above table. Vertical movement switches it to horizontal mode, sideways movement switches it to side mode, and forwards or backwards movement switches it to frontal mode.

If the rook moves in two directions, it does not switch modes, it must stay within the plane corresponding to the mode it is in, and the directions must be done in a particular order. In horizontal mode the rook moves left or right, then forwards or backwards. Similarly, in frontal mode the rook moves left or right, then up or down, and in side mode the rook moves forwards or backwards, then up or down.

QUEEN MOVEMENT

Figure 14:
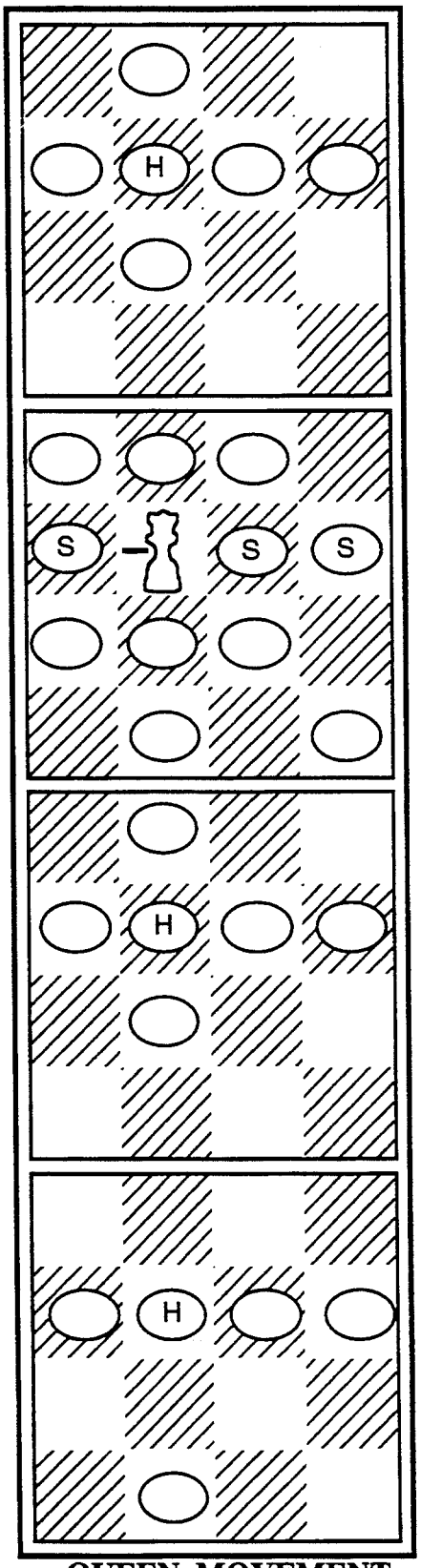
FIG. 14 shows the movements of the queen in the frontal mode.

The queen may move like a bishop or a rook (but not both in one move). It starts in horizontal mode, and it switches modes the same as a rook. Diagonal movement does not cause mode switches. An example of movement for a frontal mode queen is shown in FIG. 14, where it shifts to side or horizontal mode if it moves to a square labeled S or H, respectively.

POSSIBLE VARIATIONS IN THE GAME RULES

Having described what I currently believe to be the best mode of carrying out my invention, I shall now describe a number of possible variations to the game rules which are presented as alternate embodiments of the invention. One possible variation of the pawn movements contemplated by the inventor is to eliminate the optional sideways move during castling. Other possible variations with regards to the rook movements and change of mode include:

1) at the end of each move by a rook the player could be required to declare the mode of the rook for its next move,
2) a player could be required to use a move to declare a mode change in the rook before its next move,
3) the hierarchy of movements of the rook (i.e. left/-right before up/down, etc.) could be eliminated.

The examples in the foregoing description are given as illustrations of the presently preferred embodiments of the invention and should not be interpreted in any limiting sense. Persons skilled in the art will readily see that a great many variations are possible within the spirit and scope of the present invention. Thus the scope of the invention should be determined by the appended claims and their legal equivalents, rather than by the examples given.

I claim:

1. A method of playing three-dimensional chess, comprising the steps of:

(a) providing a three-dimensional chessboard having a plurality of levels, each of said levels being divided into a grid of squares, each of said squares being colored with one of two different colors, said two different colors alternating between adjacent squares in each of said levels, said three-dimensional chessboard defined as having a top level, a bottom level, a left side, a right side, a front, and a back, said three-dimensional chessboard further defined as having a plurality of horizontal planes which coincide with said a plurality of levels, a plurality of side planes which are parallel with the sides of said three-dimensional chessboard, and a plurality of frontal planes which are parallel with the front of said three-dimensional chessboard, (b) providing two sets of chess pieces arranged on said chessboard, each of said sets of chess pieces comprising at least a king, a queen, a rook, a bishop, a knight, and a pawn, (c) defining the movement of said rook as having three modes, a horizontal mode, a frontal mode, and a side mode; allowing said rook to move in one direction in any of the three orthogonal lines, top to bottom, side to side, or front to back, which intersect at the square occupied by said rook when said rook is in any of said three modes; allowing said rook to move sequentially in two orthogonal directions, including a move toward the right or left, and a move toward the front or back, when said rook is in said horizontal mode; allowing said rook to move sequentially in two orthogonal directions, including a move toward the right or left, and a move toward the top or bottom, when said rook is in said frontal mode; and allowing said rook to move sequentially in two orthogonal directions, including a move toward the front or back, and a move toward the top or bottom, when said rook is in said side mode.

2. The method of claim 1, wherein said rook is defined as being in said horizontal mode at the beginning of a game, and wherein when said rook moves in one direction only, said rook changes mode to the mode corresponding to the horizontal, frontal or side plane perpendicular to the direction in which said rook moves.

3. The method of claim 1, wherein said rook is allowed to move first toward the right or left, then toward the front or back, when said rook is in said horizontal mode, and said rook is allowed to move first toward the right or left, then toward the top or bottom, when said rook is in said frontal mode, and said rook is allowed to move first toward the front or back, then toward the top or bottom, when said rook is in said side mode.

4. The method of claim 1, further comprising the step of:

(d) defining the movement of said bishop as allowing said bishop to move diagonally in the horizontal plane or the frontal plane or the side plane which said bishop occupies.

5. The method of claim 4, further comprising the step of:

(e) defining the movement of said queen as allowing said queen to make any move that would be allowed for a rook as defined in step (c) or any move that would be allowed for a bishop as defined in step (d).

6. The method of claim 1, further comprising the step of:

(f) defining the movement of said king as allowing said king to move to any adjacent square or any diagonally adjacent square in the horizontal plane or the frontal plane which said king occupies.

7. The method of claim 1, further comprising the step of:

(g) defining the movement of said knight to allow said knight to move sequentially in two orthogonal directions, first one square in a non diagonal vertical or horizontal direction, then two squares in a non vertical direction perpendicular to the direction in which said knight first moved.

8. The method of claim 7, wherein the movement of said knight is further defined as allowing an optional third sequential move of two squares in a non vertical direction perpendicular to the directions of the first two sequential moves.

9. The method of claim 1, further comprising the step of:

(h) defining the movement of said pawn to allow said pawn to move either on the same level as said pawn occupies or to move between levels, and further defining that when said pawn moves on the same level said pawn moves forward one square, and when said pawn moves between levels said pawn moves backward one square and one level upward or downward.

10. A method of playing three-dimensional chess, comprising the steps of:

(a) providing a cubic chessboard having four levels, each of said levels being divided into a grid of four by four squares, each of said squares being colored with one of two different colors, said two different colors alternating between adjacent squares in each of said levels and said two different colors alternating between adjacent squares in a vertical direction, said cubic chessboard defined as having a top level, a bottom level, a left side, a right side, a front, and a back, said cubic chessboard further defined as having four horizontal planes which coincide with said four levels, four side planes which are parallel with the sides of said cubic chessboard, and four frontal planes which are parallel with the front of said cubic chessboard, (b) providing two sets of chess pieces arranged on said chessboard, each of said sets of chess pieces comprising at least a king, a queen, a rook, a bishop, a knight, and a pawn, (c) defining the movement of said rook as having three modes, a horizontal mode, a frontal mode, and a side mode; allowing said rook to move in one direction in any of the three orthogonal lines, top to bottom, side to side, or front to back, which intersect at the square occupied by said rook when said rook is in any of said three modes; allowing said rook to move sequentially in two orthogonal directions, including a move toward the right or left, and a move toward the front or back, when said rook is in said horizontal mode; allowing said rook to move sequentially in two orthogonal directions, including a move toward the right or left, and a move toward the top or bottom, when said rook is in said frontal mode; and allowing said rook to move sequentially in two orthogonal directions, including a move toward the front or back, and a move toward the top or bottom, when said rook is in said side mode.

11. The method of claim 10, wherein said rook is defined as being in said horizontal mode at the beginning of a game, and wherein when said rook moves in one direction only, said rook changes mode to the mode corresponding to the horizontal, frontal or side plane perpendicular to the direction in which said rook moves.

12. The method of claim 10, wherein said rook is allowed to move first toward the right or left, then toward the front or back, when said rook is in said horizontal mode, and said rook is allowed to move first toward the right or left, then toward the top or bottom, when said rook is in said frontal mode, and said rook is allowed to move first toward the front or back, then toward the top or bottom, when said rook is in said side mode.

13. The method of claim 10, further comprising the step of:

(d) defining the movement of said bishop as allowing said bishop to move diagonally in the horizontal plane or the frontal plane or the side plane which said bishop occupies.

14. The method of claim 13, further comprising the step of:

(e) defining the movement of said queen as allowing said queen to make any move that would be allowed for a rook as defined in step (c) or any move that would be allowed for a bishop as defined in step (d).

15. The method of claim 10, further comprising the step of:

(f) defining the movement of said king as allowing said king to move to any adjacent square or any diagonally adjacent square in the horizontal plane or the frontal plane which said king occupies.

16. The method of claim 10, further comprising the step of:

(g) defining the movement of said knight to allow said knight to move sequentially in two orthogonal directions, first one square in a non diagonal vertical or horizontal direction, then two squares in a non vertical direction perpendicular to the direction in which said knight first moved.

17. The method of claim 16, wherein the movement of said knight is further defined as allowing an optional third sequential move of two squares in a non vertical direction perpendicular to the directions of the first two sequential moves.

18. The method of claim 10, further comprising the step of:

(h) defining the movement of said pawn to allow said pawn to move either on the same level as said pawn occupies or to move between levels, and further defining that when said pawn moves on the same level said pawn moves forward one square, and when said pawn moves between levels said pawn moves backward one square and one level upward or downward.

* * * * *